US008189820B2

(12) United States Patent
Wang

(10) Patent No.: US 8,189,820 B2
(45) Date of Patent: May 29, 2012

(54) MICROPHONE ASSEMBLY WITH UNDERFILL AGENT HAVING A LOW COEFFICIENT OF THERMAL EXPANSION

(75) Inventor: Christian Wang, Copenhagen (DK)

(73) Assignee: Sonion MEMS A/S, Roskilde (DK)

( * ) Notice: Subject to any disclaimer, the term of this patent is extended or adjusted under 35 U.S.C. 154(b) by 381 days.

(21) Appl. No.: 12/488,775

(22) Filed: Jun. 22, 2009

(65) Prior Publication Data

US 2009/0316946 A1 Dec. 24, 2009

Related U.S. Application Data

(63) Continuation of application No. PCT/EP2007/011045, filed on Dec. 17, 2007.

(60) Provisional application No. 60/876,918, filed on Dec. 22, 2006.

(51) Int. Cl.
*H04R 25/00* (2006.01)

(52) U.S. Cl. ..... 381/174; 381/369; 381/175

(58) Field of Classification Search ..... 381/173, 381/174, 175, 355, 369, 113; 29/25.35, 25.41, 29/25.42; 257/686, 777, 778; 438/108
See application file for complete search history.

(56) References Cited

U.S. PATENT DOCUMENTS 6,088,463 A * 7/2000 Rombach et al. ..... 381/174
6,522,762 B1 2/2003 Mullenborn et al.
2003/0230798 A1 12/2003 Lin et al.
2005/0253240 A1 * 11/2005 Nuechter et al. ..... 257/686
2006/0008098 A1 1/2006 Tu

FOREIGN PATENT DOCUMENTS

EP 1 473 769 A2 3/2004
WO WO 2005/086532 A2 9/2005

OTHER PUBLICATIONS

Lau, J., et al., "Polymers for Electronic Packaging: Materials, Processes, and Reliability," Electronic Packaging, Feb. 1998, pp. 427-442, © The McGraw-Hill Companies.
Wong, C.P., et al., "Novel high performance no flow and reworkable underfills for flip-chip applications," Materials Research Innovations, 1999, pp. 232-247, © Springer-Verlag.
Luo, S., et al., "Study on Property of Underfill Based on Epoxy Cured with Acid Anhydride for Flip Chip Application," Journal of Electronics Manufacturing, vol. 10, No. 3, 2000, pp. 191-200, © World Scientific Publishing Company.
Fine, P., et al., "Flip Chip Underfill Flow Characteristics and Prediction," IEEE Transactions on Components and Packaging Technologies, vol. 23, No. 3, Sep. 2000, pp. 420-427, IEEE.

(Continued)

*Primary Examiner* — Huyen D Le
(74) *Attorney, Agent, or Firm* — Slater & Matsil, L.L.P.

(57) ABSTRACT

A microphone assembly includes a carrier, a silicon-based transducer, a conducting element, and an underfill agent. The carrier has a first surface holding an electrical contact element. The silicon-based transducer includes a displaceable diaphragm and an electrical contact element. The transducer is arranged at a distance above the first surface of the carrier. The conducting material is arranged to obtain electrical contact between the electrical contact elements of the carrier and the silicon based transducer. The underfill agent is disposed in a space between the silicon based transducer and the silicon based carrier. The underfill agent has an underfill coefficient of thermal expansion, CTE, below 40 ppm/° C.

23 Claims, 1 Drawing Sheet

OTHER PUBLICATIONS

Chen, L., et al., "The Effects of Underfill and Its Material Models on Thermomechanical Behaviors of a Flip Chip Package," IEEE Transactions on Advanced Packaging, vol. 24, No. 1, Feb. 2001, pp. 17-24, IEEE.

Xiao, G-W, et al., "Reliability Study and Failure Analysis of Fine Pitch Solder Bumped Flip Chip on Low-Cost Printed Circuit Board Substrate," 2001 IEEE Electronic Components and Technology Conference, May 29-Jun. 1, 2001, pp. 598-605, IEEE.

Li, H., et al., "Development of New No-Flow Underfill Materials for both Eutectic Sn-Pb Solder and a High Temperature Melting Lead-Free Solder," IEEE Transactions on Components and Packaging Technologies, vol. 26, No. 2, Jun. 2003, pp. 466-472, IEEE.

Sun, Y., et al., "Study and Characterization on the Nanocomposite Underfill for Flip Chip Applications," IEEE Transactions on Components and Packaging Technologies, vol. 29, No. 1, Mar. 2006, pp. 190-197, IEEE.

Gilleo, K. "The Chemistry & Physics of Underfill," http://www.cooksonsemi.com/products/polymer/technicalarticles.asp, downloaded Sep. 2009, pp. 1-13, © 2001-2007 Cookson Electronics Assembly Materials.

* cited by examiner

MICROPHONE ASSEMBLY WITH UNDERFILL AGENT HAVING A LOW COEFFICIENT OF THERMAL EXPANSION

This application is a continuation of co-pending International Application No. PCT/EP2007/011045, filed Dec. 17, 2007, which designated the United States and was published in English, and which claims priority to U.S. Provisional Application No. 60/876,918 filed Dec. 22, 2006, both of which applications are incorporated herein by reference.

FIELD OF THE INVENTION

The present invention relates to a microphone assembly having a silicon-based transducer arranged above a carrier, with an underfill agent having an advantageously low coefficient of thermal expansion being provided for filling at least part of a space between the silicon-based transducer and the carrier.

BACKGROUND OF THE INVENTION

In the field of electronic packaging and, in particular, the field of integrated circuit (IC) chip interconnection, the desirability of incorporating high input/output (I/O) capability and short IC interconnects typically has led to the adoption of the flip-chip technique of IC chip interconnection. Generally, the flip-chip technique involves electrically interconnecting an IC chip and a substrate with the use of solder joints, which are disposed between the IC chip and the substrate.

It is also known in the prior art to fill the spaces or gaps remaining between an IC chip and substrate, which are not occupied by solder, with an underfill composition or encapsulant. The encapsulant may be an adhesive which serves to reinforce the physical and mechanical properties of the solder joints between the IC chip and the substrate. The encapsulant typically not only provides fatigue life enhancement of a packaged system, but also provides corrosion protection to the IC chip by sealing the electrical interconnections of the IC chip from moisture.

WO 2005/086532 discloses various packaging solutions for microstructure elements such as integrated circuit chips and microelectromechanical device chips.

US 2006/0008098 discloses a single crystal silicon micromachined capacitive microphone. Capacitive elements of the single crystal silicon microphone are made up of two epitaxial single crystal silicon layers.

The article "Reliability study and failure analysis of fine pitch solder bumped flip chip on low-cost printed circuit board substrate", by Guo-wei Xiao, et al., 2001 Proceedings of the Electronic Components and Technology Conference, New York, Ny: IEEE, US, ISBN 0-7803-7038-4, deals with electrically interconnection of an IC chip with a low-cost printed circuit board substrate using flip-chip on board, FCOB, technology U.S. Pat. No. 6,522,762 discloses a silicon microphone assembly formed as a so-called "chip-scale package". The silicon microphone assembly comprises a microelectromechanical (MEMS) transducer die, a separate integrated circuit die and a silicon carrier substrate with through holes formed therein. The MEMS transducer die and the integrated circuit are adjacently positioned and both attached to an upper surface of the silicon carrier substrate by flip chip bonding through respective sets of bond pads. U.S. Pat. No. 6,522,762 also discloses an example of a chip-scale package, wherein an underfill or glue is provided for filling out spaces or gaps between the transducer die and the silicon carrier substrate and between the integrated circuit and the silicon carrier substrate.

However, because the coefficient of thermal expansion (CTE) of silicon is 3 ppm/° C. and commercially available underfill agents have CTEs of about 40 ppm/° C. or higher, these underfill agents are not well-adapted for use in microphone assemblies that comprise a silicon or MEMS based transducer. The difference in CTE between the underfill agent and silicon based components of the microphone assembly leads to a number of significant problems including:

(i) warping of the substrate wafer due to CTE induced stress will cause problems with wafer dicing after assembly of the individual MEMS microphone packages on the substrate wafer;

(ii) reliability issues such as strain fatigue caused by thermal mismatches of materials in the microphone assembly itself, (iii) change of the microphone performance due to non-completed curing processes;

(iv) change of the electroacoustical microphone performance such as frequency response and sensitivity during heating of the microphone assembly, for example during reflow soldering in SMT assembly or in connection with high temperature exposure in normal use, caused by thermal mismatches of the materials.

Therefore, there is a need to provide an improved microphone assembly which comprises a suitably disposed underfill agent with a CTE that provides an improved match for the CTE of silicon or MEMS based transducers contained in the microphone assembly.

SUMMARY OF THE INVENTION

According to the present invention, a microphone assembly comprises a carrier, a silicon-based transducer, a conducting element, and an underfill agent. The carrier has a first surface holding an electrical contact element. The silicon-based transducer comprises a displaceable diaphragm and an electrical contact element. The transducer is arranged at a distance above the first surface of the carrier. The conducting material is arranged to obtain electrical contact between the electrical contact elements of the carrier and the silicon based transducer. The underfill agent is disposed in a space between the silicon based transducer and the carrier. The underfill agent has an underfill coefficient of thermal expansion, CTE, below 40 ppm/° C.

In an embodiment of the invention, the carrier is silicon-based.

It is preferred that the underfill agent comprises at least a first material or material composition having a first CTE, and a second material or material composition having a second CTE being lower than the first CTE. Here, the second material or material composition may be a CTE-lowering filler material or material composition.

Preferably, the first material or material composition comprises an organic polymer-based adhesive component.

It is within one or more embodiments of the invention that the first material of the underfill agent is a first material composition comprising an organic polymer-based adhesive component, a catalyst and a hardener, and that the second material or material composition of the underfill agent comprises one or more filler materials.

According to one or more embodiments of the invention, the material(s) used for the first material or material composition are selected so that the first CTE is above or equal to 50 ppm/° C. It is also within one or more embodiments of the invention that the material(s) used for the second material or material composition are selected so that the second CTE is less than about 15 ppm/° C., or less than about 1 ppm/° C.

It is preferred that the materials and the amounts of the materials used for the first and the second materials or material compositions are selected so that the underfill agent has a overall coefficient of thermal expansion, $CTE_1$ below 25 ppm/° C. or below 20 ppm/° C. It is also preferred that the materials used for the first and the second materials or material compositions are selected so that the underfill agent is an electrically non-conductive underfill agent.

Preferably, the materials used for the first and the second materials or material compositions are selected so that the glass transition temperature, Tg, of the underfill agent is above 80° C., such as above 125° C., or such as above 150° C.

For embodiments of the invention wherein the first material or material composition comprises an organic polymer-based adhesive component, this organic polymer-based adhesive component of the first material may comprise cyanate ester resin or an epoxy based resin or a blend of these materials.

It is within one or more embodiments of the invention that the second material or material composition comprises fused silica as a CTE-lowering filler material.

It is also within one or more embodiments of the invention that the second material or material composition comprises a filler material having a negative CTE. Here, the second material or material composition may comprise Zirconium Tungstate.

The present invention also covers one or more embodiments, wherein the second material or material composition comprises a filler material having a positive CTE and a filler material having a negative CTE. Here, the second material or material composition may comprise fused silica and Zirconium Tungstate.

In order for the underfill to be able to fill the gap between the lower surface of the silicon-based transducer and the first surface of the carrier, the particle size of the filler should be tailored or adapted to the height of the gap. Thus, it is preferred that the filler has a particle size below or equal to ½ or ⅓ of the gap which equals the vertical distance between the lower surface of the transducer and the first carrier surface. The gap between the transducer and the first surface of the carrier preferably has a size or height in the range of 15-100 μm. Thus, it is often preferred that the material(s) used for the filler has a particle size below or equal to 50 μm, such as below or equal to 35 μm, such as below or equal to 10 μm, such as below or equal to 5 μm.

The CTE of the underfill may be tuned by the amount of CTE-lowering filler material used for the underfill. It is within embodiments of the invention that the second CTE-lowering filler material or material composition is in the range of about 5 to about 70 of wt % of the underfill agent.

The present invention also covers embodiments, wherein the polymer-based adhesive component is about 10 to about 70 of wt % of the underfill agent.

The present invention covers different embodiments of arrangement of the carrier and the transducer element. Preferably, at least one contact element of the transducer element is aligned with at least one contact element of the carrier member, with the conducting material being provided between the aligned contact elements.

It is within one or more preferred embodiments that the underfill agent fills up the space between the transducer and the first surface of the carrier corresponding to a part of first surface area.

BRIEF DESCRIPTION OF THE DRAWINGS

In the following, the invention will be described with reference to the drawings, wherein.

DETAILED DESCRIPTION OF THE INVENTION

The process for manufacturing the different elements of the microphone assembly according to the present invention involves a number of known technologies within the field of micro-technology.

Figure 1:
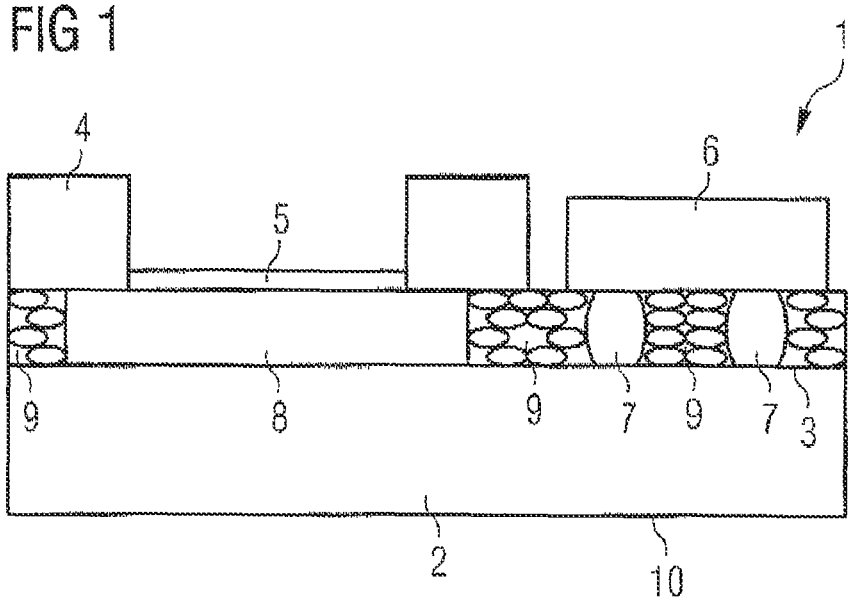
FIG. 1 is an illustration of a general application of a microphone assembly with a silicon based transducer according to an embodiment of the present invention.

A microphone assembly 1 according to an embodiment of the present invention is shown in FIG. 1. Here, the microphone assembly 1 comprises a carrier 2 being the microphone substrate, which may be bulk crystalline silicon, having a first surface 3 holding electrical contact elements. A silicon-based transducer 4 or microphone comprising a displaceable diaphragm 5 and which may have electrical contact elements (not shown) is arranged at a distance above the first surface 3 of the carrier 2. Also an electronic device in the form of an application specific integrated circuit (ASIC) 6 is arranged above the first surface 3 of the carrier, and a conducting material in the form of solder bumps 7 is arranged to obtain electrical contact between the electrical contact elements of the carrier and the ASIC 6. A solder sealing ring 8 provides acoustic sealing for a pressure sensitive portion of the silicon-based transducer 4, and further provides an electrical contact path between the silicon-based transducer 4 and the first or upper surface 3 of the carrier 2. An underfill or underfill agent 9 is disposed in the space outside the solder sealing ring 8 between the silicon based transducer 4 and the carrier 2, and an underfill or underfill agent 9 is also disposed in the space between the ASIC 6 and the first surface 3 of the carrier 2. The carrier 2 comprises a second, lower surface 10 opposite the first surface 3, where solder bumps for surface mounting of the entire microphone assembly onto, e.g., a PCB may be arranged.

It is preferred that the silicon-based transducer comprises a capacitive transducer forming part of a condenser microphone. Here, the microphone assembly may have a front chamber and a diaphragm formed at the transducer part, and a back chamber formed in the carrier part of the assembly.

According to the present invention, different substrate materials may be used for the carrier part of the microphone assembly. Such substrate materials may include:

(i) Bulk crystalline silicon;

(ii) Substrate fabricated by the LTTC (low temperature co-fired ceramics) Technology;

(iii) Substrates fabricated by the HTTC (high temperature co-fires ceramics) Technology;

(iv) Low CTE PCB such as STABLCOR® (Thermalworks, CTE=0-3 ppm/° C.) and Thermount® (Dupont, CTE=8-12 ppm/° C.);

(v) Standard PCB such as FR2 PCB, High Tg FR4 PCB, FR4 PCB, FR5 PCB, BT-resin PCB, polyimide PCB, and Cyanate ester resin-based PCB; and (vi) Alumina substrate technology.

According to an embodiment of the present invention the underfill comprises a first material or material composition having an organic polymer-based adhesive component, and a second material or material composition having a CTE-lowering filler material or material composition.

The CTE-lowering filler material or material composition may comprise a filler with a rather low, but positive, CTE, such as less than 1 ppm/° C., and/or a filler with a negative CTE.

By using a filler material with a low, positive CTE and/or a negative CTE as part of the underfill agent used in a microphone assembly with a silicon-based transducer, is it possible to lower the large difference between the respective CTE's of the materials making up the microphone assembly.

The filler material with the low or negative CTE may have a low or negative CTE in all crystal directions (isotropic) or in a single or two orthogonal crystal directions (anisotropic).

The filler material with the low or negative CTE may be blended in a matrix of another compound which has a positive CTE such as a polymer or blended together with another filler material of positive CTE or a combination of the two, a blend of another filler material (which may be of positive CTE) and a matrix of another compound, which may be an epoxy compound.

A filler material with a low, positive CTE may be fused silica, which has a CTE of 0.5 ppm/° C. Other materials with a positive CTE and which may be used as the CTE-lowering filter material are:

(i) Silica particles Glass fibers;
(ii) Carbon fibers;
(iii) Diamond (CTE=0.8);
(iv) Boron Nitride (BN) (CTE=<1);
(v) Aluminum Nitride (CTE=4.4);
(vi) Silicon Carbide;
(vii) Alumina ($A_2O_3$) (CTE=6.6);
(viii) Silicon-coated Aluminum Nitride.

By using a filler material with a negative CTE it is possible to lower the CTE of the blended underfill matrix material to 25 ppm/° C. or even lower.

The physical form of the blended underfill matrix can be a liquid, a paste or a solid laminate foil. The liquid form can be deposited by spraying, spin coating or dispensing with a needle or jetdispensing. The paste can be deposited with a screen-printing technique on a wafer, which may be used for the carrier substrate, and the solid laminate foil can be deposited by a lamination of a wafer. For all three forms, the blended underfill material may advantageously be cured after deposition by heating, and an adhesion of the carrier substrate and the silicon-based transducer may take place during this heating.

A filler material with a negative CTE may be Zirconium Tungstate ($ZrW_2O_8$). It has a CTE of −9.1 ppm/° C. up to 157° C., where a phase transition of the crystal structure takes place. The new phase has a CTE of −5.4 ppm/° C. By using blends with predetermined ratios of Zirconium Tungstate and a polymer-based adhesive material with positive CTE, it is possible to tune the CTE of the blended underfill matrix material to a rather low, positive value, or even to small negative values, up to 400° C. It is also possible to tune the compressive stress seen in a normally blended underfill matrix material as a function of temperature to a lower value as the compressive stress will be absorbed by the thermal negative growth of the Zirconium Tungstate crystals.

Other materials with a negative CTE and which may be used as the CTE-lowering filter material are Vectran fibers (a liquid crystal polymer) or Kevlar fibers (Aramid polymer). These materials are having a CTE of −4.8 ppm/° C. and −4.9 ppm/° C., respectively, in the temperature range of 20-145° C. Ultra high modulus of high performance polyethylene (UHMPE or HPPE) fibers also have a small, negative CTE. Even carbon nanotubes have a negative CTE in one direction.

Figure 2:
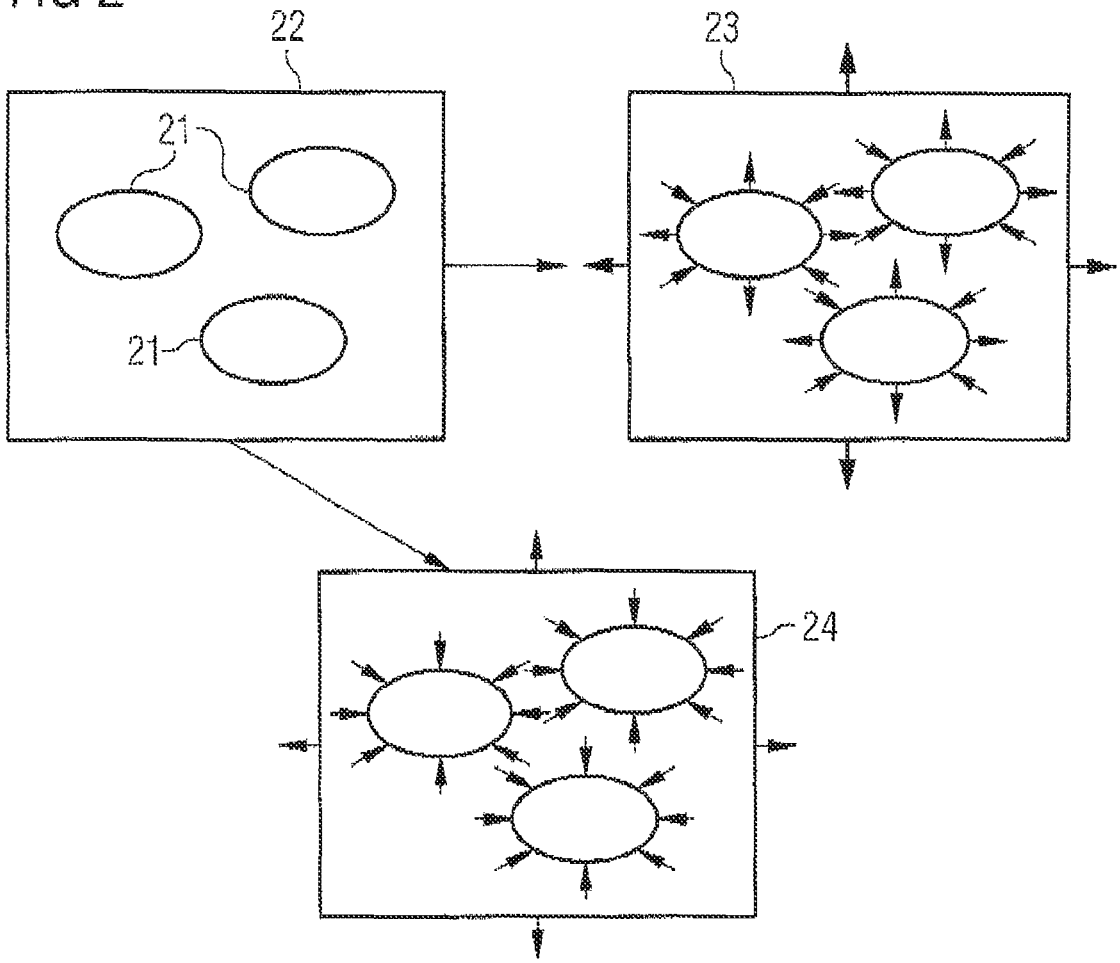
FIG. 2 is a schematic drawing illustrating the difference between an underfill having a Silica filler material with a positive CTE and an underfill having Zirconium Tungstate filler particles with a negative CTE.

FIG. 2 is a schematic drawing illustrating the difference between an underfill having filler particles with a positive CTE and an underfill having filler particles with a negative CTE. The underfill contains filler particles 21 within an epoxy matrix 22. When using Silica filler material for the filler particles 21 as indicated by 23, there is a relatively large net expansion of the blended underfill matrix material as a function of temperature, but when using Zirconium Tungstate material for the filler particles 21 as indicated by 24, there is a relatively small net expansion as a function of the temperature or even a negative expansion dependent on the ratio of the materials.

An underfill according to the present invention may contain the following ingredients:

(i) Epoxy resin(s) or Urethane resin(s) or Cyanate ester resin(s) or blends of Cyanate ester/epoxy resin(s);
(ii) Hardener or cross-linker;
(iii) Catalyst;
(iv) Fillers, with a positive, low CTE and/or fillers with a negative CTE; and
(v) Additives.

The underfill may further contain the following ingredients:

(i) Flame retardant;
(ii) Filler coupling agent (additive).

According to a preferred embodiment of the invention the underfill comprises an epoxy resin.

As a filler material with a positive, low CTE, fused silica with a CTE of 0.5 ppm/° C. may be used. The epoxy resin, hardener, catalyst and the additives cooperate to create a material with a relatively high positive CTE, which may be in the range of 50-200 ppm/° C. The addition of a CTE-lowering filler material, such as fused silica filler, reduces the overall CTE of the underfill to an advantageous value of less than 40 ppm/° C., more preferably below 30 ppm/° C., such as 20 ppm/° C.

According to a preferred embodiment of present invention, an underfill agent with CTE below 40 ppm/° C. comprises:

| Underfill Blend | Amount |
|---|---|
| Epoxy resin: 3,4-epoxy cyclohexylmethyl-3,4-epoxy cyclohexyl carboxylate (ERL4221E, Union Carbide) | 1 mol |
| Epoxy resin: Poly (bis-phenol A-co-epichloro-hydrin), glycidyl end capped (Aldrich or EPON 8281, Shell) | 1 mol |
| Hardener: hexahydro-4-methylphthalic anhydride (Lindau Chemicals, Inc.) | 1.6 mol |
| Catalyst: 1-cyanoethyl-2-ethyl-4-methylimidazole-trimelliate (Shikoku Chemicals) | 0.03 mol |
| Filler particles: $Zr_2WO_4$, 10 μm in particle size. (1, 2) | 70 vol % |
| Filler coupling agent: γ-glycidoxypropyl-trimethoxysilane | 3 wt % (of filler) |
| Filler coupling agent: tetra-n-butyl titanate | 1 wt % (of filler) |

Other embodiments of the invention are obtained by variations of the above-specified underfill blend.

One set of embodiments comprises, respectively: 60 vol %, 50 vol %, 40 vol %, 30 vol %, 20 vol %, 10 vol % of $Zr_2WO_4$, 10 μm in particle size.

Another set of embodiments comprises addition of fused silica: A blend Of $Zr_2WO_4$ and fused silica filler particles in different ratios with the total volumes percentage within the range of 10-70 vol %.

Examples of fabrication and composition of underfill blends with large positive CTEs are disclosed in various prior art documents such as:

1) Ref.: "Electronic Packaging, Design, Materials, Process, and Reliability" p. 428-442 by John Lau, CP. Wong, John L. Prince and Wataru Nakayama; and 2) Ref.: "Novel high performance no flow and reworkable underfills for flip-chip applications", Mat REs Innovat (1999) 2:232-247.

A recipe for a no-flow underfill based epoxy resin is given in the above-mentioned references where experiments were performed on different blends. From this recipe underfills with a Tg greater than 150° C. were obtained. In general, it is mentioned that silica has been widely used as the filler in the underfill formulation to lower the CTE of epoxy resin. Up to 70% (by the weight of filler) loading has been used in commercial products.

Epoxy resin is 3,4-epoxy cyclohexyl methyl-3,4-epoxy cyclohexyl carboxylate provided by Union Carbide under the tradename ERL-4221 D and was used as received. The molecular weight and epoxy equivalent weight (EEW) of the epoxy resin is 252.3 g/mol and 133 g, respectively. The hardener or cross-linker is hexahydro-4-methylphthalic anhydride (HMPA) from Aldrich Chemical Company, Inc., and was used as received. HMPA molecular weight is 168.2 g/mol and its purity is more than 97 percent. As for curing catalysts different metal acethylacetonate salts, known to be effective in accelerating the curing reaction of bisphenol A/anhydride systems, were used. The names of the catalysts are given by: Cobolt (II) acetylacetonate [CH3COCH═C(O—)CH3]2Co, Cobalt (III) acetylacetonate [CH3COCH═C(O—)CH3]3Co, Iron (III) acetylacetonate [CH3COCH═C(O—)CH3]3Fe.

Also sodium, potassium and lanthanide acetylacetonates are also capable of acting as latent catalyst.

| Name of chemicals | Usage quantity (parts by weight) |
|---|---|
| Cycloaliphatic epoxy resin | 100 |
| Curing hardener | 30~100 |
| Curing catalysts (see above) | 0.1~1 |

The specified quantity of hardener was added into the epoxy resin and then the mixture was stirred for more than 2 hours at 60 to 70° C. until the catalyst was homogeneously dissolved.

An alternative example of fabrication and composition of an underfill blend with large positive CTE is in prior art document: Ref: Article: "Study on property of underfill based on epoxy cured with acid anhydride for flip chip application" by Shijian Luo, Tsuyoshi Yamashita, C P. Wong, Journal of electronics Manufacturing, Vol. 10, No. 3 (2000) 191-299. In this reference, three different epoxy resins were studied; ERL4221 (cycloaliphatic type), EPON862 (bisphenol F type), and EPON 8281 (bisphenol A type) were cured with acid anhydride as the hardener using different catalyst: cobolt acetylacetonate (CAA), imidazole derivatives, and tertiary amines. All of the materials used in this study were reportedly used as received from the following manufacturers and vendors. The cycloaliphatic epoxy resin ERL4221 with epoxy equivalent weight (EEW) of 134 g/eqv. is from Union Carbide. The bisphenol-A epoxy EPON8281 with EEW of 187 g/eqv. and bisphenol-F epoxy EPON 862 with EEW of 171 g/eqv. are from Shell Chemicals. The hardener 4-methylhexahydrophthalic anhydride (MHHPA), is from Aldrich Chemicals. The catalysts: cobolt (II) acethylacetonate (CAA), dimethylbenzylamine $(DMBA)_1$ and 1,8-diazabiscyclo(5,4,0)-undec-7-ene (DBU) are also from Aldrich Chemicals. The imidazole derivatives: 2E4MZ-CN (1-cyanoethyl-2-ethyl-4-methylimidazole) and 2PHZ (2-phenol-4,5-dihydroxymethylimidazole) are from Shikoku Chemicals.

First, epoxy resin was mixed with the hardener according to the following weight ratios:

ERL4221/MHHPA is 1.0/1.0; EPON8281/MHHPA is 1.0/0.72; and EPON862/MHHPA is 1.0/0.79.

Then the desired amount of catalyst was added into the mixture. When CAA was used as catalyst, its concentration was 0.4% of total weight of resin and hardener. When tertiary amines were used as catalysts, their concentrations were 1% of total weight of resin and hardener. When imidazole derivatives were used as catalysts, their concentrations were 0.4% of the total weight of resin and hardener.

| Name of chemicals | Usage quantity (parts by weight) |
|---|---|
| ERL4221 Cycloaliphatic epoxy resin | 100 |
| MHHPA Curing hardener | 100 |
| or | |
| EPON8281 bisphenol-A epoxy resin | 100 |
| MHHPA Curing hardener | 72 |
| or | |
| EPON 862 bisphenol-F epoxy resin | 100 |
| MHHPA Curing hardener | 79 |

Together with the

Curing catalysts (see above)

| | |
|---|---|
| CAA | 0.4 wt % |
| Tertiary amines | 1.0 wt % |
| Imidazole derivatives | 0.4 wt % |

The filler coupling agent is an additive that makes the filler more easily dispersible into an organic system, or even makes the filler into a reinforcing material.

Organosilanes can be used as a filler coupling agent.

The general formula of an organosilane shows two classes of functionality:

$$RnSiX_{(4-n)}$$

Silicone (Si) is the center of the silane molecule which contains an organic functional group (R) [e.g., vinyl, amino, chloro, epoxy, mercapto, etc.], with a second functional group (X) [e.g., methoxy, ethoxy, etc.]. The functional group (R) will attach to an organic resin while the alkoxy group (X) attaches to an inorganic material (the fillers) or substrate to achieve a "coupling" effect.

There are two basic approaches for using silane coupling agents. The silane can either be used to treat the surface of the inorganic materials (the fillers) before mixing with the organic resin or it can be added directly to the organic resin. At the last mentioned method the silane coupling agent also will bond to a silicon substrate surface as an adhesion promoter and a mechanical reinforcement of the underfill will occur.

A recipe for a high CTE filler material or composition that includes a filler coupling agent is disclosed in: Ref: Article: "Study and Characterization on the Nanocomposite Underfill for Flip Chip Applications", by Yangyang Sun, Zhuqing Zhang, C. P. Wong, IEEE Transactions on components and Packaging Technologies, Vol. 29, No: 1, p. 190-197, March 2006. In the reference above an example of a recipe of an underfill with nanoparticles treated with filler coupling agents is described. Silica nanoparticles ($SiO_2$, 100 nm average diameter) were commercially available and used as-received or treated with silane additives. For comparison, conventional silica with a 3-μm average diameter was also used as filler. The epoxy used was diglycidyl ether of Bisphenol-A type (EPON828, from Shell Chemicals with a average molecular weight of 377). The hardener was hexahydro-4-methylphthalic anhydride (HMPA, from Lindau Chemicals). A polymer-encapsulated imidazole derivative from Shikoku Chemicals was used as a latent catalyst, γ-glycidoxypropyltrimethoxysilane (GPTMS) and surface-active additive tetra-n-butyl titanate (TnBT) were used as the silica modification compounds into the underfills. All these chemicals were used as received.

The base polymer formulation was prepared by mixing EPON828 and HMPA with a weight ratio of 1:0.75. After stirring the polymer mixture for 10 minutes, the catalyst, with 1 wt % based on the polymer mixture, was added into the polymer liquid and stirred for another 30 minutes until a homogenous polymer solution was achieved. A specified quantity of filler was added into the base polymer and the mixture was sonicated for 30 minutes using a Sonicator (Misonix 3000) at a power of 450 W. To treat the nanosilica surface, 3 wt % silane GPTMS and 1 wt % TnBT based on the weight of the silica filler were added and the mixture was sonicated for another 5 min. The filler loading of the composite was 5%, 10%, 20%, 30%, and 40% in weight percent.

| | Usage quantity (parts by weight) |
|---|---|
| Name of chemicals | |
| EPON828 (bisphenol-A type) epoxy resin | 100 |
| HMPA Curing hardener | 75 |
| Curing catalyst (see above) | 1 wt % |
| Filler content | 5, 10, 20, 30 wt % |
| Filler coupling agent: | |
| GPTMS | 3 wt % (filler) |
| TnBT | 1 wt % (filler) |

Constraints on the gap height to the filler particle size are described in reference: Ref.: "The chemistry & physics of underfill" by Dr. Ken Gilleo, Alpha Metals Cranston, $R1_1$ downloaded from Cookson homepage http/www.cookson-.com. According to this reference, flip-chip gap sizes may range from a high of up to 12 mils (300 μm) (for solder bumped PCBs) down to a low of about 15 μm for thermocompression bonded chips on flexible substrate. Empirical tests have shown that flow is greatly restricted unless the gap is more than twice the filler particle diameter. When the gap height is 2.1 times the maximum particle diameter, underfill will flow between the chip and substrate under ideal circumstances. However, if a glass slide is placed over a PCB, surface roughness comes into play and a 3:1 gap to filler size is recommended.

A microphone assembly suitable for use in the present invention often comprises cavities in the range of 15-100 microns, and it is therefore preferred that the particles sizes of the fillers should be in the range of or below 7-50 μm.

Advantages are seen using nano-sized particles of the filler in the underfill on the viscosity and filler loading extent (see ref. 5). Mono-dispersed nanosilica filler of 100 nm in size were used in this study.

It is therefore within one or more preferred embodiments of the present invention that the particle size of the materials used for the filler is in the range of 1 nm to 50 μm such as 1-10 μm.

What is claimed is:

1. A microphone assembly comprising:

a carrier having a first surface holding an electrical contact element;

a silicon-based transducer comprising a displaceable diaphragm and an electrical contact element, said transducer being arranged at a distance above the first surface of the carrier;

a conducting material electrically coupled between the electrical contact element of the carrier and the silicon based transducer; and an underfill agent disposed in a space between the silicon based transducer and the carrier, wherein said underfill agent has an underfill coefficient of thermal expansion (CTE) below 40 ppm/° C.;

wherein the underfill agent comprises at least a first material or material composition having a first CTE, and a second material or material composition having a second CTE that is lower than the first CTE; and wherein the first material or material composition of the underfill agent is a first material composition comprising an organic polymer-based adhesive component, a catalyst and a hardner, and wherein the second material or material composition of the underfill agent comprises one or more filler materials.

2. The microphone assembly according to claim 1, wherein the second material or material composition comprises a CTE-lowering filler material or material composition.

3. The microphone assembly according to claim 1, wherein the first material or material composition comprises an organic polymer-based adhesive component.

4. The microphone assembly according to claim 1, wherein the material(s) used for the second material or material composition is/are selected so that the second CTE is less than about 15 ppm/° C.

5. The microphone assembly according to claim 1, wherein the underfill agent is a non-conductive underfill agent.

6. The microphone assembly according to claim 1, wherein the materials and the amount of materials used for the first and second materials or material compositions are selected so that the underfill agent has a coefficient of thermal expansion (CTE) below 25 ppm/° C.

7. The microphone assembly according to claim 1, wherein the materials and the amount of materials used for the first and second materials or material compositions are selected so that the glass transition temperature (Tg) of the underfill agent is above 80° C.

8. The microphone assembly according to claim 7, wherein the materials and the amount of materials used for the first and second materials or material compositions are selected so that the glass transition temperature (Tg) of the underfill agent is above 150° C.

9. The microphone assembly according to claim 1, wherein the organic polymer-based adhesive component of the first material comprises an epoxy base resin and/or a cyanate ester resin.

10. The microphone assembly according to claim 1, wherein the second material or material composition comprises fused silica.

11. The microphone assembly according to claim 1, wherein the materials used for the underfill agent have a particle size less than or equal to ½ or ⅓ of the distance between the transducer and the first carrier surface.

12. The microphone assembly according to claim 1, wherein the materials used for the underfill agent have a particle size below or equal to 50 μm or 35 μm.

13. The microphone assembly according to claim 1, wherein the first material composition comprises an organic polymer-based adhesive component, the organic polymer-based adhesive component being about 10 to about 70 of wt % of the underfill agent.

14. A microphone assembly comprising:

a carrier having a first surface holding an electrical contact element;

a silicon-based transducer comprising a displaceable diaphragm and an electrical contact element, said transducer being arranged at a distance above the first surface of the carrier;

a conducting material electrically coupled between the electrical contact element of the carrier and the silicon based transducer; and an underfill agent disposed in a space between the silicon based transducer and the carrier, wherein said underfill agent has an underfill coefficient of thermal expansion (CTE) below 40 ppm/° C.;

wherein the underfill agent comprises at least a first material or material composition having a first CTE, and a second material or material composition having a second CTE that is lower than the first CTE;

wherein the second material or material composition comprises a CTE-lowering filler material or material composition; and wherein the second material or material composition comprises a filler material having a negative CTE.

15. The microphone assembly according to claim 14, wherein the second material or material composition comprises Zirconium Tungstate.

16. The microphone assembly according to claim 14, wherein the second material or material composition comprises a filler material having a positive CTE and a filler material having a negative CTE.

17. The microphone assembly according to claim 16, wherein the second material or material composition comprises fused silica and Zirconium Tungstate.

18. The microphone assembly according to claim 14, wherein the CTE-lowering filler material or material composition is about 5 to about 70 of wt % of the underfill agent.

19. The microphone assembly according to claim 14, wherein the electrical contact element of the transducer element is aligned with the electrical contact element of the carrier member, and wherein the conducting material is provided between said aligned contact elements.

20. The microphone assembly according to claim 14, wherein the underfill agent fills the space between the transducer and the first surface of the carrier corresponding to a part of a first surface area.

21. The microphone assembly according to claim 14, wherein the second material or material composition comprises fused silica.

22. A microphone assembly comprising:

a carrier having a first surface holding an electrical contact element;

a silicon-based transducer comprising a displaceable diaphragm and an electrical contact element, said transducer being arranged at a distance above the first surface of the carrier;

a conducting material electrically coupled between the electrical contact element of the carrier and the silicon based transducer; and an underfill agent disposed in a space between the silicon based transducer and the carrier, wherein said underfill agent has an underfill coefficient of thermal expansion (CTE) below 40 ppm/° C.;

wherein the underfill agent comprises at least a first material or material composition having a first CTE, and a second material or material composition having a second CTE that is lower than the first CTE;

wherein the second material or material composition comprises a CTE-lowering filler material or material composition; and wherein the second material or material composition comprises a filler material having a positive CTE and a filler material having a negative CTE.

23. The microphone assembly according to claim 22, wherein the second material or material composition comprises fused silica and Zirconium Tungstate.

* * * * *